US008715004B2

(12) United States Patent
Crighton

(10) Patent No.: US 8,715,004 B2
(45) Date of Patent: May 6, 2014

(54) BACKPLANE CONNECTOR WITH REDUCED CIRCUIT BOARD OVERHANG

(75) Inventor: Alan D. Crighton, Apex, NC (US)

(73) Assignee: FCI Americas Technology LLC, Carson City, NV (US)

( * ) Notice: Subject to any disclaimer, the term of this patent is extended or adjusted under 35 U.S.C. 154(b) by 321 days.

(21) Appl. No.: 13/189,296

(22) Filed: Jul. 22, 2011

(65) Prior Publication Data

US 2012/0030146 A1 Feb. 2, 2012

Related U.S. Application Data

(60) Provisional application No. 61/368,044, filed on Jul. 27, 2010.

(51) Int. Cl.
*H01R 13/648* (2006.01)

(52) U.S. Cl.
USPC ..... 439/607.07

(58) Field of Classification Search
USPC ..... 439/607.07, 607.11, 79, 607.4
See application file for complete search history.

(56) References Cited

U.S. PATENT DOCUMENTS

| | | | | |
|---|---|---|---|---|
| 5,173,056 | A | 12/1992 | Kniese et al. | |
| 5,453,016 | A | 9/1995 | Clark et al. | |
| 5,664,968 | A | 9/1997 | Mickievicz | |
| 6,036,506 | A | 3/2000 | Korsunsky | |
| 6,979,215 | B2 | 12/2005 | Avery et al. | |
| 7,331,800 | B2 | 2/2008 | Winings et al. | |
| 7,621,760 | B1 | 11/2009 | Barr et al. | |
| 7,815,444 | B2 | 10/2010 | Minich | |
| 2007/0207641 | A1 | 9/2007 | Minich | |
| 2008/0207011 | A1 | 8/2008 | Goosens et al. | |
| 2008/0261417 | A1 | 10/2008 | Minich | |
| 2009/0124101 | A1 * | 5/2009 | Minich et al. | 439/79 |

FOREIGN PATENT DOCUMENTS

| | | |
|---|---|---|
| EP | 1075714 B1 | 7/2004 |
| WO | WO 99/56352 | 11/1999 |

* cited by examiner

*Primary Examiner* — Phuong Dinh
(74) *Attorney, Agent, or Firm* — Baker & Hostetler

(57) ABSTRACT

A right-angle electrical connector is configured to be mounted onto an upper mounting surface of a substrate that defines a bottom surface opposed from the upper mounting surface so as to define a thickness. The connector includes a connector housing and a plurality of electrical contacts retained by the connector housing. The connector housing overhangs an edge of the substrate and extends down with respect to the upper surface to a depth from the upper mounting surface that is less than the thickness of the substrate.

14 Claims, 8 Drawing Sheets

BACKPLANE CONNECTOR WITH REDUCED CIRCUIT BOARD OVERHANG

CROSS-REFERENCE TO RELATED APPLICATIONS

This claims the benefit of US. Patent Application Ser. No. 61/368,044 filed Jul. 27, 2010, the disclosure of which is hereby incorporated by reference as if set forth in its entirety herein.

BACKGROUND

Electrical connectors are configured to electrically connect first and second electrical components so as to place the electrical components in electrical communication. For instance, electrical connectors can define a mounting interface that is configured to mount onto a substrate (e.g., printed circuit board), and a mating interface that is configured to mate with a complementary electrical component.

Referring to FIGS. 1A-B, one such conventional electrical connector 10 includes a connector housing 11 that defines a mating interface 12 and a mounting interface 13. The housing 11 supports a plurality of electrical contacts 14 that can include a plurality of signal contacts S and a plurality of ground contacts G that separate adjacent pairs of signal contacts, which can define differential signal pairs. The electrical contacts can define respective mounting portions 15 that are disposed at the mounting interface 13 and are configured to electrically connect to a substrate 38, such as a printed circuit board. The electrical contacts 14 further define mating portions 17 disposed at the mating interface 12 that are configured to electrically connect to a complementary electrical component, such as an electrical connector. The electrical connector can be configured as a right-angle electrical connector whereby the mating interface 12 is oriented substantially perpendicular to the mounting interface 13. Typically, the size and position of the right angle connector may limit the physical arrangement of circuit boards within the device. The connector 10 in accordance with certain embodiments can be constructed as described in U.S. Pat. No. 7,815,444, U.S. Pat. No. 7,331,800, the disclosure of each of which is incorporated by reference as if set forth herein in its entirety.

The substrate 38 defines an upper surface 43 and an opposed lower surface 45 that is opposite the upper mounting surface 43, and an outer edge 47 that partially defines the outer perimeter of the substrate 38. The substrate 38 further defines an outer edge 19 that extends between the upper and lower mounting surfaces 43 and 45. The substrate 38 can define any transverse substrate thickness T between the opposed upper and lower surfaces 43 and 45 as desired, for instance between approximately 0.05 inches and approximately 0.15 inch, such as approximately 0.092 inches. As illustrated in FIG. 1B, the connector housing 11 overhangs the edge 47 of the substrate 38, such that the connector housing 11 extends down from the upper mounting surface 43 to a depth D1 that is greater than the transverse substrate thickness T of the substrate, and thus is greater than 0.92 inches. Thus, the connector housing 11 extends down to a location below the lower surface 45 of the substrate 38.

In electrical devices where physical space is limited, it may be desirable to limit the height of the right angle connector. For example, in backplane applications within a fixed chassis, a reduced connector height can reduce the distance between circuit boards and ultimately increase the volume within the chassis that is available for occupation by printed circuit boards, thereby increasing the quantity of circuit boards that can be installed within the chassis.

SUMMARY

In accordance with one embodiment, a right-angle electrical connector is configured to be mounted onto a printed circuit board that includes an upper mounting surface and an opposed lower surface. The electrical connector can include a connector housing and a plurality of electrical contacts supported by the connector housing. The connector housing can include a rear portion configured to rest against the upper mounting surface when the electrical connector is mounted onto the printed circuit board. The connector housing can further include a front portion that is spaced from the rear portion and is configured to overhang the upper mounting surface and extend down toward the lower surface and terminate without crossing a plane defined by the lower surface when the electrical connector is mounted onto the printed circuit board.

BRIEF DESCRIPTION OF THE DRAWINGS

The foregoing summary, as well as the following detailed description of an example embodiment of the application, will be better understood when read in conjunction with the appended drawings, in which there is shown in the drawings an example embodiment for the purposes of illustration. It should be understood, however, that the application is not limited to the precise arrangements and instrumentalities shown. In the drawings.

DETAILED DESCRIPTION

Figure 2:
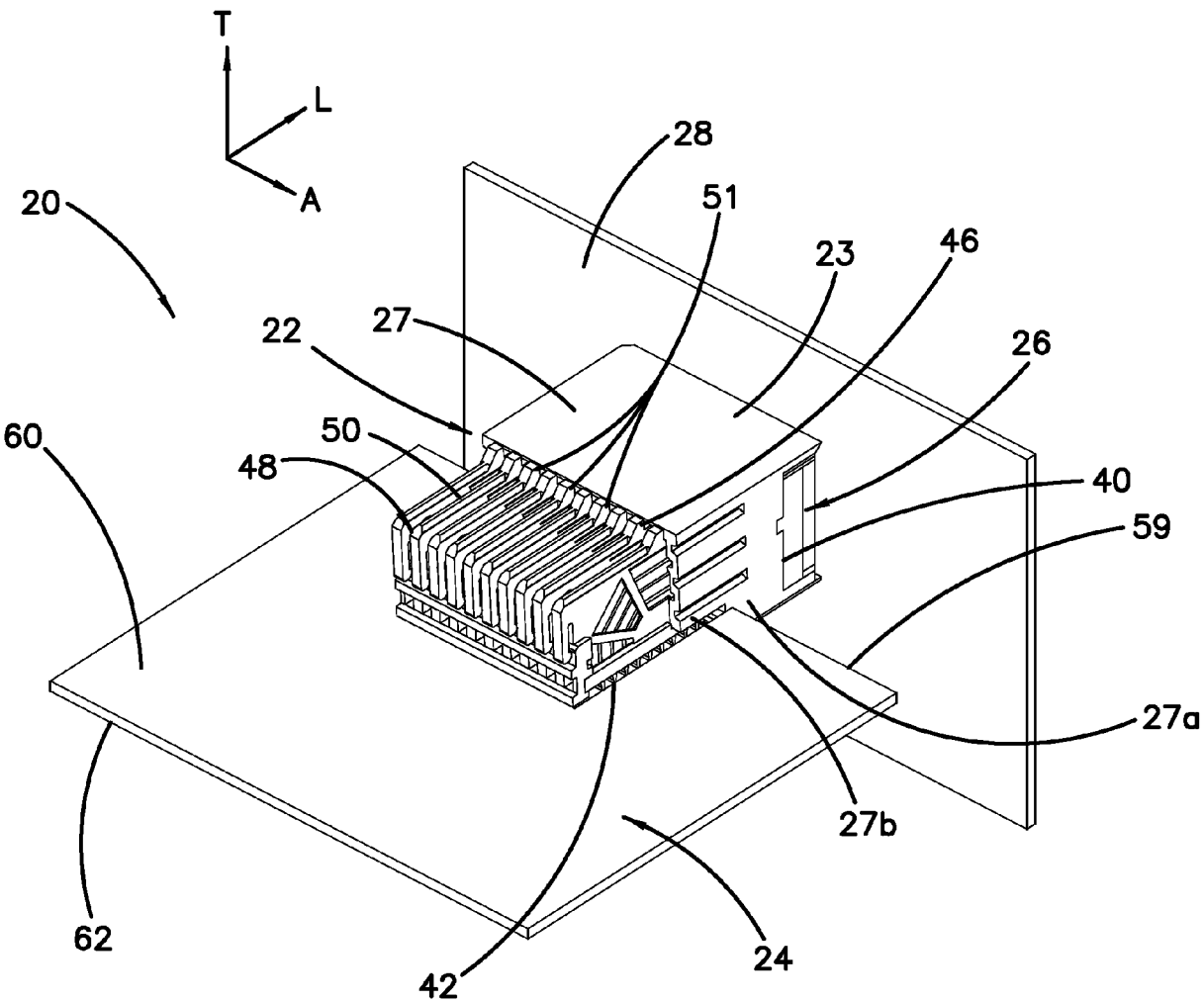
FIG. 2 is a perspective view of an electrical connector system constructed in accordance with one embodiment.
Figure 3A:
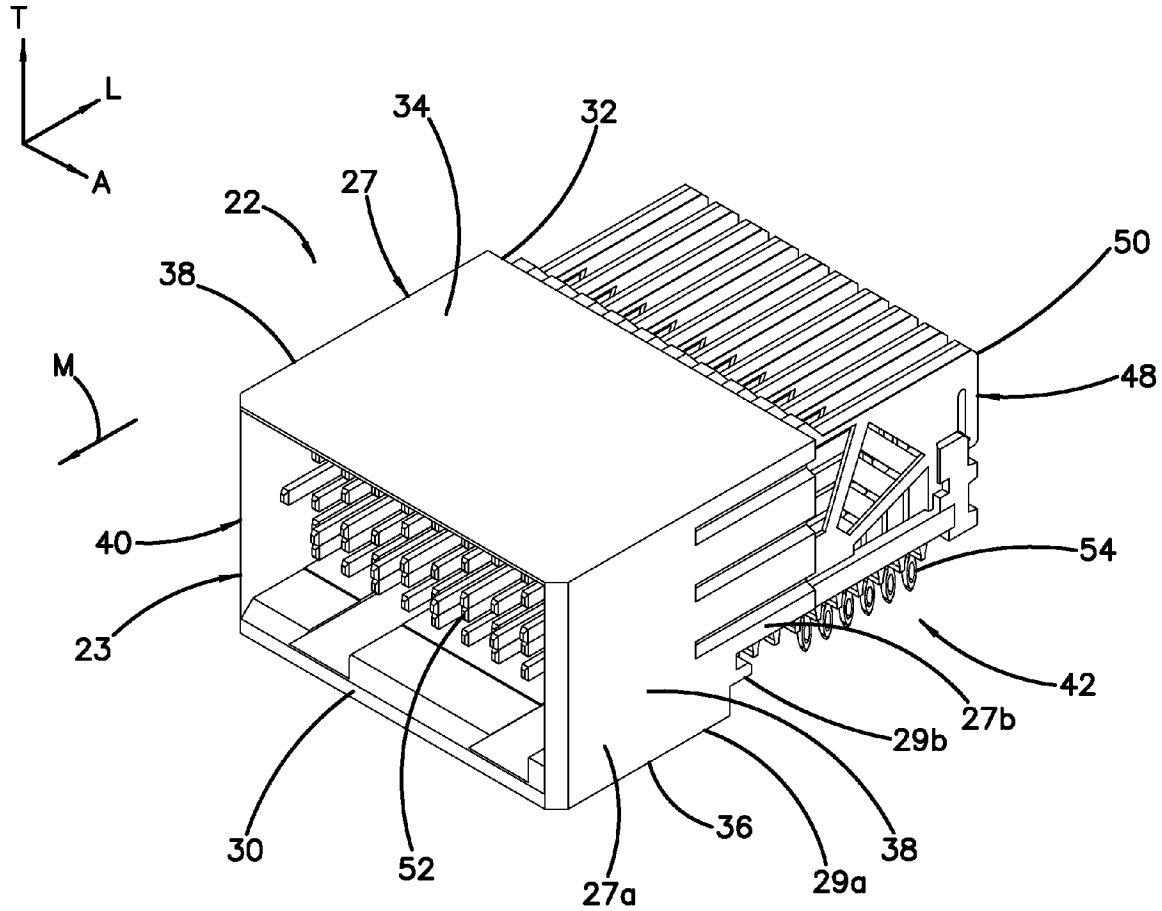
FIG. 3A is a top perspective view of an electrical connector of the electrical connector system illustrated in FIG. 2.
Figure 3B:
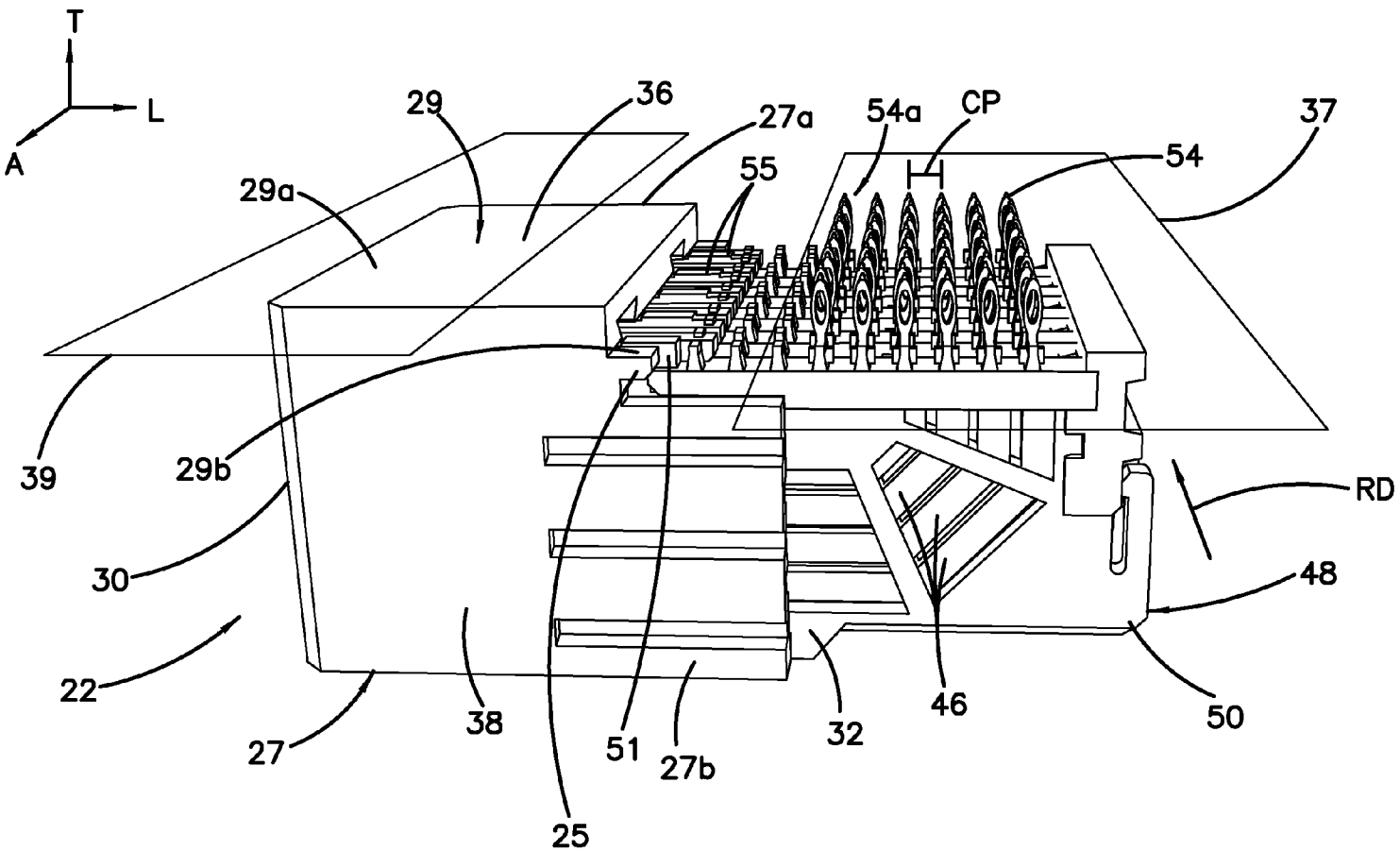
FIG. 3B is a bottom perspective view of the electrical connector illustrated in FIG. 3A.

Referring to FIG. 2-3B, an electrical connector system 20 includes a first electrical connector 22 configured to be electrically connected, or mounted, to a first substrate 24 which can be provided as a printed circuit board (PCB), and a complementary second electrical connector 26 configured to be electrically connected, or mounted, to a second substrate 28 such as a PCB. The first and second electrical connectors 22 and 26 are configured to mate with each other so as to place the first and second substrates 24 and 28 in electrical communication with each other.

In accordance with the illustrated embodiment, the electrical connector first 22 includes a connector housing 27 that is dielectric or electrically insulative, and defines a front end 30 and an opposed rear end 32, a top end 34 and an opposed bottom end 36 that extend between the front and rear ends 30 and 32, and opposed sides 38 that extend between the opposed top and bottom ends 34 and 36, and further extend between the opposed front and rear ends 30 and 32. The front end rear ends 30 and 32 are spaced apart along a longitudinal direction L, the opposed sides 38 are spaced apart along a lateral direction A that is substantially perpendicular with respect to the longitudinal direction L, and the top and bottom ends 34 and 36 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the connector housing 27 may vary during use. The connector housing 27 defines a longitudinally front portion 27*a* that can define the front end 30, and an opposed longitudinally rear portion 27*b* that can define the rear end 31. The longitudinally front portion 27*a* is disposed longitudinally forward of the longitudinally rear portion 27*b*. The top end 34, the bottom end 36, and the sides 38 of the connector housing 27 can extend along and between the longitudinally front and rear portions 27*a* and 27*b*, respectively. The connector housing 27 may be made from any suitable dielectric material, such as a plastic, and can be injection molded or otherwise fabricated using any desired process.

The first electrical connector 22 defines a mating interface 40 that is disposed proximate to the front end 30 of the connector housing 27 and a mounting interface 42 disposed proximate to the bottom end 36 of the connector housing 27. The mounting interface 42 is configured to operatively engage the first substrate 24, which can be provided as a printed circuit board (PCB) so as to place the electrical connector in electrical communication with the substrate 24, while the mating interface 40 is configured to operatively engage or mate with the second electrical connector 26 so as to place the first electrical connector 22 in electrical communication with the second electrical connector 26. For instance, the mating interface 40 can include a forwardly extending guide portion 23 that is configured to receive a complementary guide portion of a complementary connector housing of the second electrical connector 26, thereby aligning the connector housing 27 with the complementary connector housing as the first and second electrical connectors 22 and 26 are mated.

In accordance with the illustrated embodiment, the first electrical connector 22 can be moved along a longitudinally forward mating direction M relative to the second electrical connector 26 so as to operably engage the mating interface 40 with the mating interface of the complementary electrical connector, thereby mating the first electrical connector 22 to the complementary electrical connector 26. Thus, the electrical connectors 22 and 26 can be mated so as to place the first and second substrates 24 and 28 in electrical communication. In accordance with the illustrated embodiment, the first electrical connector 22 can be moved along a longitudinally rearward direction relative to the second electrical connector 26 so as to operably disengage the mating interface 40 from the mating interface of the second electrical connector 26, thereby unmating, or electrically disconnecting, the first electrical connector 22 from the second electrical connector 26. Because the mating interface 40 is oriented substantially perpendicular to the mounting interface 42, the first electrical connector 20 can be referred to as a right-angle electrical connector. The second electrical connector 26 can be constructed as a vertical connector whereby the mating interface and the mounting interface are oriented substantially parallel to each other as illustrated, or as a right-angle connector whereby the mating interface and the mounting interface are oriented substantially perpendicular to each other.

Figure 3C:
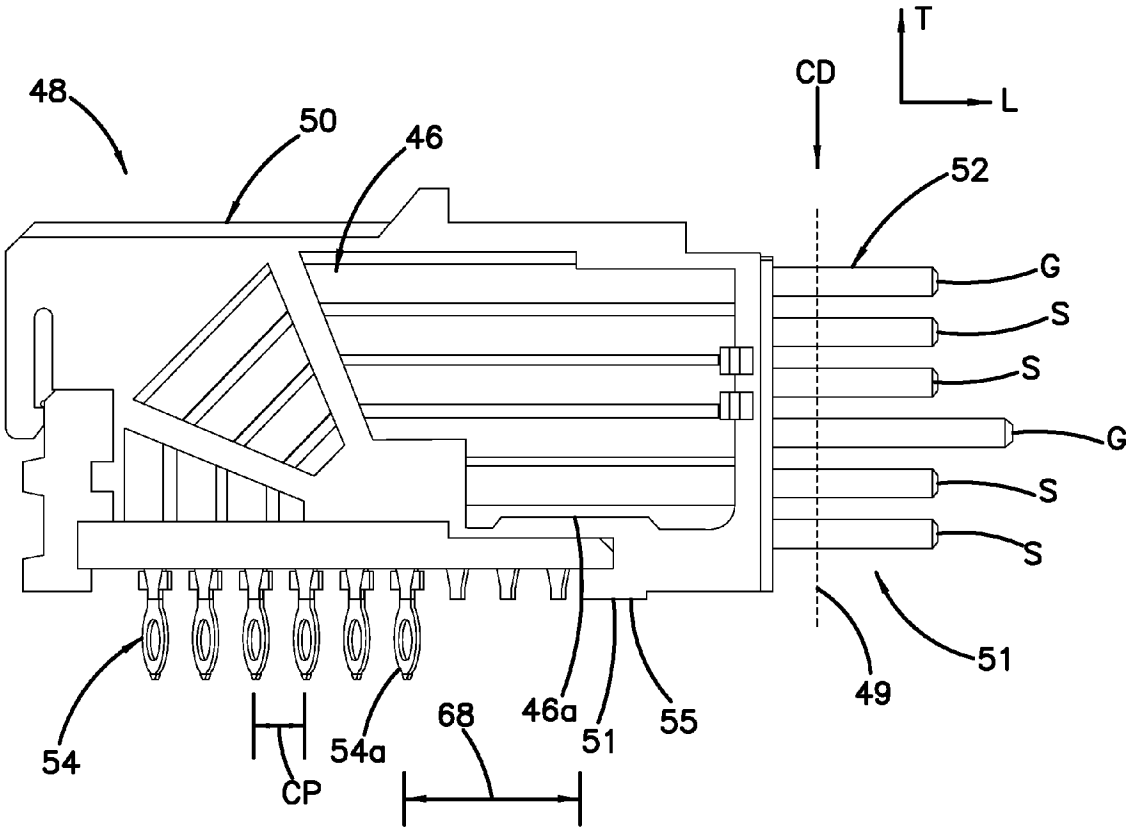
FIG. 3C is a side elevation view of a leadframe assembly of the electrical connector illustrated in FIG. 3B.
Figure 4A:
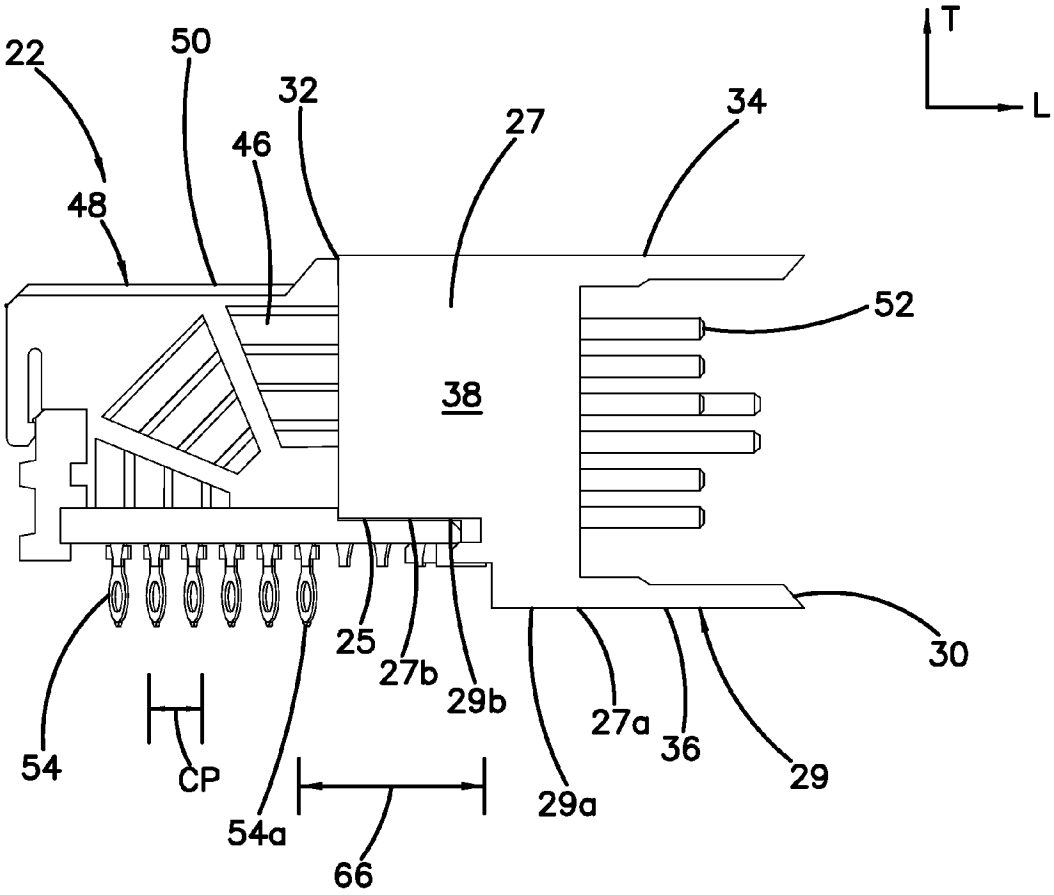
FIG. 4A is a schematic side elevation view of the electrical connector illustrated in FIG. 3A.

Referring also to FIGS. 3C and 4A, the electrical connector 20 includes a plurality of electrical contacts 46 that are electrically conductive and retained by the connector housing 27. In particular, the first electrical connector 22 can include at least one leadframe assembly 48, such as a plurality of leadframe assemblies 48 are supported by the connector housing 27. Each leadframe assembly 48 can include a respective leadframe housing 50, which can be made from any suitable dielectric material, and a plurality of the electrical contacts 46 that are supported by the leadframe housing 50. In accordance with one embodiment, the leadframe assemblies 48 can be configured as insert molded leadframe assemblies (IMLAs), whereby the electrical contacts 46 are overmolded by the leadframe housing 50. Alternatively, the electrical contacts 46 can be stitched into the leadframe housing 50 or otherwise supported by the leadframe housing 50 as desired. The electrical contacts 46 each define a mating portion 52 disposed proximate to the mating interface 40, and an opposed mounting portion 54 disposed proximate to the mounting interface 42.

In accordance with the illustrated embodiment, the mating portions 52 are arranged substantially along a mating plane that is defined by the lateral and transverse directions A and T, respectively, and are configured to electrically connect to complementary electrical contacts of the second electrical connector 26 when the first electrical connector 22 is mated with the second electrical connector 26, thereby placing the second electrical connector 26 in electrical communication with the first substrate 24. In accordance with the illustrated embodiment, the mating portions 52 provide header contacts that are received in complementary receptacles of the second electrical connector 26. Accordingly, the first electrical connector 22 can be referred to as a header connector. It should be appreciated, however, that the first electrical connector 22 can alternatively be configured as a receptacle connector whereby the mating portions 52 receive the electrical contacts of the second electrical connector 26.

In accordance with the illustrated embodiment, the mounting portions 54 of the electrical contacts 46 are arranged along a horizontal first plane 37 (see FIG. 3B), which can define a mounting plane, that is defined by the longitudinal and lateral directions L and A, respectively. Thus, it should be appreciated that the first plane 37 is substantially perpendicular to the mating plane. Furthermore, in accordance with the illustrated embodiment, the mating interface 40 is oriented substantially perpendicular with respect to the mounting interface 42, and the mating portions 52 of the electrical contacts 46 are substantially perpendicular with respect to the mounting portions 54. Thus, the first electrical connector 22 can be referred to as a right-angle electrical connector, and is illustrated as a right-angle header connector as described above.

The mounting portions 54 of the electrical contacts 46 can extend transversely down with respect to the bottom end 36 of the rear portion 27*b* of the connector housing 27, and further extend down from the respective leadframe housing 50, and are configured to electrically connect to electrical traces that are carried by the first substrate 24. For instance, the mounting portions 54 can be configured as press-fit tails that can be press-fit into complementary apertures, or vias, defined by the first substrate 24, can be configured as solder tails that can be surface mounted, for instance soldered, onto complementary contact pads of the first substrate 24, or otherwise attached to the first substrate 24 so as to place the electrical contacts 46 in electrical communication with the electrical traces of the first substrate 24.

Referring now also to FIGS. 3B-4A, a plurality up to all of electrical contacts 46 of a given leadframe assembly 48 can be spaced from each other along a column direction CD that can be defined by a common centerline 49 that can extend along the transverse direction T for instance at the mating portions 46. Adjacent leadframe assemblies 48 can be spaced from each other along a row direction RD that can extend along the lateral direction A. Thus, the electrical contacts 46 of each leadframe assembly 48 can be arranged in a plurality of transversely extending columns 51, and the electrical contacts 40 of each leadframe assembly 48 can be spaced from the electrical contacts 46 of adjacent leadframe assemblies 48 along the lateral row direction RD. The electrical connector 20 can include as many columns and rows of electrical contacts 46 as desired. The electrical contacts 46 can include at least one signal contact S such as a plurality of signal contacts S alone or in combination with at least one ground contact G such as a plurality of ground contacts G. The respective mating portions 52 of certain ones up to all of the ground contacts G can extend forward from those of the signal contacts S, or can be inline with those of the signal contacts S as desired. The signal and ground contacts S and G can be arranged in any desired pattern along the row direction and/or column direction. In accordance with the illustrated embodiment, the electrical contacts 46 can be arranged in a repeating signal-signal-ground pattern in a transverse direction along the column direction. The signal-signal-ground pattern can begin with the first or second signal contact or the ground contact as defined by the electrical contact 46 that defines the uppermost mating portion 52. Adjacent pairs of signal contacts S, for instance along a common centerline, can define a differential signal pair that are separated by a ground contact G, or can define single-ended contacts.

As described above, the mounting portions 54 of the electrical contacts 46 extend transversely out, or down, from the bottom end 36 of the connector housing 27. In accordance with the illustrated embodiment, the bottom end 26 of the connector housing 27 defines a bottom surface 29. The bottom surface 29 defines a corresponding first or longitudinally front bottom surface portion 29*a* at the front portion 27*a* of the connector housing 27, and a second or longitudinally rear bottom surface portion 29*b* at the rear portion 27*b* of the connector housing 27 that is longitudinally spaced from the front bottom surface portion 29*a*. For instance, in accordance with the illustrated embodiment, the longitudinally front bottom surface portion 29*a* is disposed longitudinally forward with respect to the longitudinally rear bottom surface portion 29*b*. Furthermore, the longitudinally rear bottom surface portion 29*b* is disposed transversely inward, or above, the longitudinally front bottom surface portion 29*a*. For instance, the longitudinally rear bottom surface portion 29*b* can lie in the horizontal first plane 37, which can define a mounting plane, that is defined by the longitudinal and lateral directions L and A, and the longitudinally front bottom surface portion 29*a* can lie in a horizontal second plane 39 that is defined by the longitudinal and lateral directions L and A. In accordance with the illustrated embodiment, the first plane 37 is parallel to the second plane 39 and is disposed transversely spaced (for instance outward or down) from the second plane 39. Thus, the first plane 37 can be parallel to and offset from the second plane 39. The mounting portions 54 of the electrical contacts 46 extend down with respect to the rear bottom surface portion 29*b*.

Figure 4B:
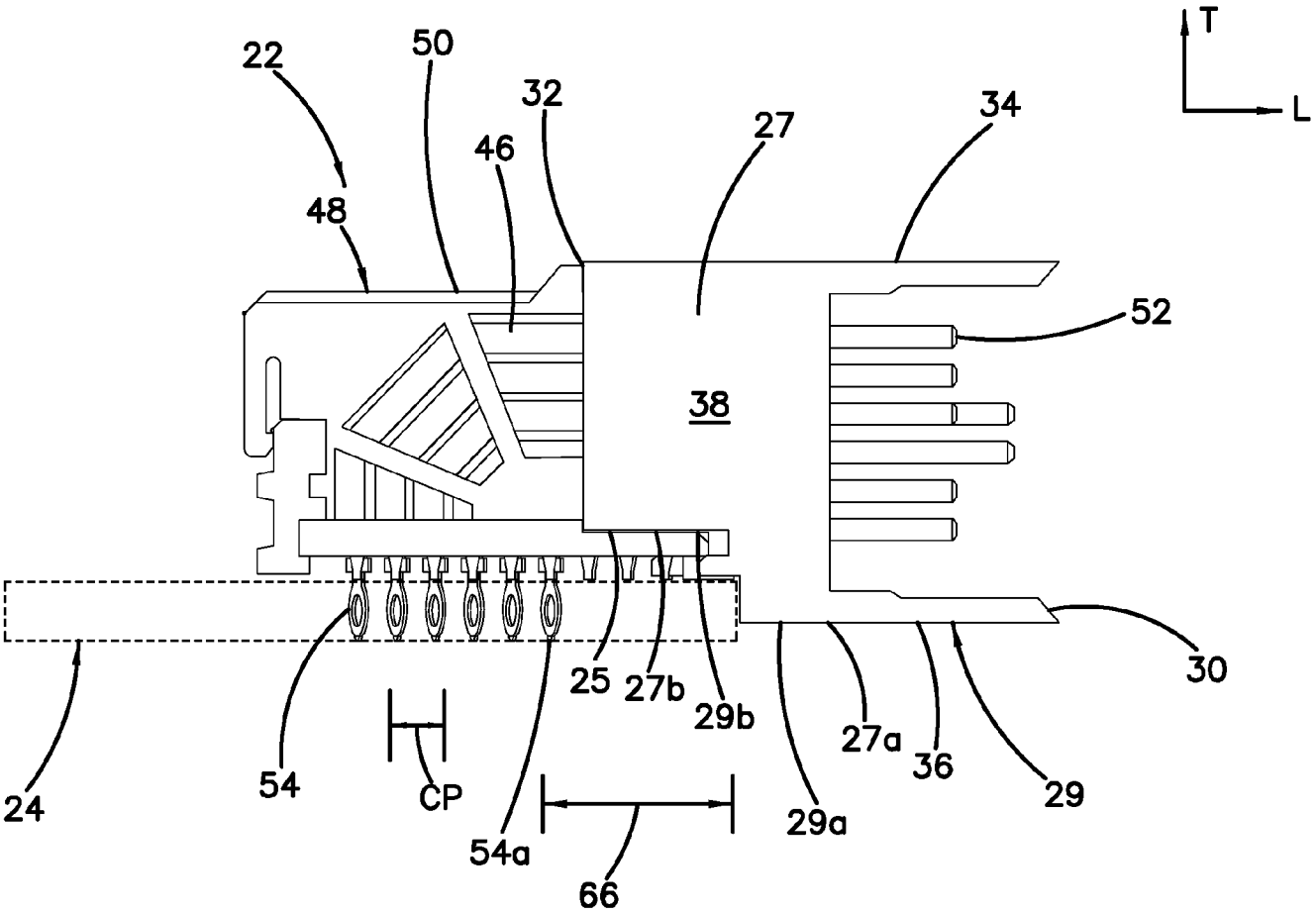
FIG. 4B is a side elevation view of the electrical connector illustrated in FIG. 4A, shown mounted to a substrate.

Referring to FIGS. 2 and 4B, the first substrate 24 defines an upper surface 60 that can define an upper mounting surface, and an opposed lower surface 62 that is spaced from the upper surface 60 along the transverse direction T. The first substrate 24 further defines an outer edge 59 that partially defines the outer perimeter of the first substrate 24, and an outer surface 53 that extends between the upper and lower surfaces 60 and 62. The first substrate 24 can define any transverse substrate thickness T between the opposed upper and lower surfaces 60 and 62 as desired, for instance between approximately 0.05 inches and approximately 0.15 inch, such as approximately 0.092 inches. For instance, in accordance with the illustrated embodiment, the outer surface can define a transverse length between the opposed upper and lower surfaces 60 and 62 as desired, for instance between approximately 0.05 inches and approximately 0.15 inch, such as approximately 0.092 inches. The connector housing 27 can overhang the edge 59 of the first substrate 24, such that the connector housing 27 extends down from the upper surface 60 along the outer surface 53 to a depth D2 that is less than the transverse substrate thickness T of the substrate, and thus is less than 0.92 inches. Otherwise stated, the connector housing 27, for instance at the front portion 27*a*, extends down from the second or longitudinally rear bottom surface portion 29*b* at the rear portion 27*b* a distance less than 0.92 inches. Thus, the connector housing 27 extends down from the upper surface 60 of the first substrate 24 to a location above the lower surface 62 of the first substrate 24. It should be appreciated that the connector housing 27 can further extend out from the upper surface 60 and remain above the first plane 37 defined by the upper surface 60 if desired, such that the depth D2 is zero.

In accordance with the illustrated embodiment, the rear bottom surface portion 29*b* is mounted to the first substrate 24, and the front bottom surface portion 29*a* is disposed forward of the first substrate 24 once the first electrical connector 22 is mounted to the first substrate 24. Thus, the first plane 37 can extend substantially along the upper surface 60 of the first substrate 24, and the second plane 39 can extend substantially parallel to the first plane and can be disposed between respective planes defined by the upper surface 60 and the lower surface 62 of the first substrate 24.

The rear portion 27*b* of the connector housing 27 can include a support ledge 25 that extends rearward from the front portion 27*a* of the connector housing 27. The support ledge 25 can define the rear bottom surface portion 29*b* that is configured to rest against the upper mounting surface 60 of the first substrate 24 when the first electrical connector 24 is mounted to the first substrate 24. Similarly, as illustrated in FIG. 3B, each of the leadframe housings 50 define a support ledge 51 that is aligned with the support ledge 25 of the connector housing 27. The support ledges 51 can define bottom surfaces 55 that are aligned with the rear bottom surface portion 29*b* of the support ledge 25. Accordingly, the rear bottom surface portion 29*b* of the support ledge 25 and the bottom surfaces 55 of the support ledges 51 can lie in, and define, the first plane 37. Thus, when the first electrical connector 22 is mounted to the first substrate 24, the bottom surfaces 55 and the rear bottom surface portion 29*b* are configured to rest against the upper surface 60 of the first substrate 24.

As described above, the connector housing 27 overhangs the edge 59 of the first substrate 24, and extends down from the edge 59 along the outer surface 53 of the first substrate 24 when the connector housing 27 is mounted to the first substrate 24. In accordance with the illustrated embodiment, the longitudinally front portion 27*a* of the connector housing 27 overhangs the edge 59 and extends down from the edge 59 along the outer surface 53. Referring now to FIGS. 3B-C, the mounting portions 54 of the electrical contacts 46 of each of the leadframe assemblies 48 are spaced apart longitudinally along a column pitch CP that is the distance from center-to-center of the mounting portions 54 of adjacent electrical contacts 46 of a respective leadframe assembly 48. Furthermore, the mounting portions 54 of a select number 46*a* among the plurality of electrical contacts 46 of each leadframe assembly 48 define forward-most mounting portions 54*a* that is spaced closer to the longitudinally front portion 27*a* of the connector housing 27 than any other of the mounting portions 54 of the respective leadframe assembly 48. Thus, the leadframe assembly 48 does not define any mounting portions 54 that are disposed between the forward-most mounting portion 54*a* and the longitudinally front portion 27*a* of the connector housing 27.

Furthermore, referring to FIG. 4A, in accordance with the illustrated embodiment, the first electrical connector 24 can define a longitudinal gap 66 between the forward-most mounting portion 54*a* and the longitudinally front portion 27*a* of the connector housing 27 that can be greater than the column pitch CP, greater than twice the column pitch CP, and greater than three times the column pitch CP. In accordance with the embodiment illustrated in FIG. 3C, each leadframe assembly 48 defines a gap 68 between the forward-most mounting portion 54*a* and the support ledge 51, which can define a location of the first electrical connector 22 that is aligned, for instance transversely, with the outer edge 59 of the first substrate 24, that is greater than column pitch CP, greater than twice the column pitch CP, greater than three times the column pitch CP, and greater than four times the column pitch CP. In accordance with the illustrated embodiment, the gaps 66 and 68 can be less than any distance as desired, for instance less than nine times the column pitch CP, for instance less than eight times the column pitch CP, including less than seven times the column pitch CP, such as less than six times the column pitch CP.

Figure 1A:
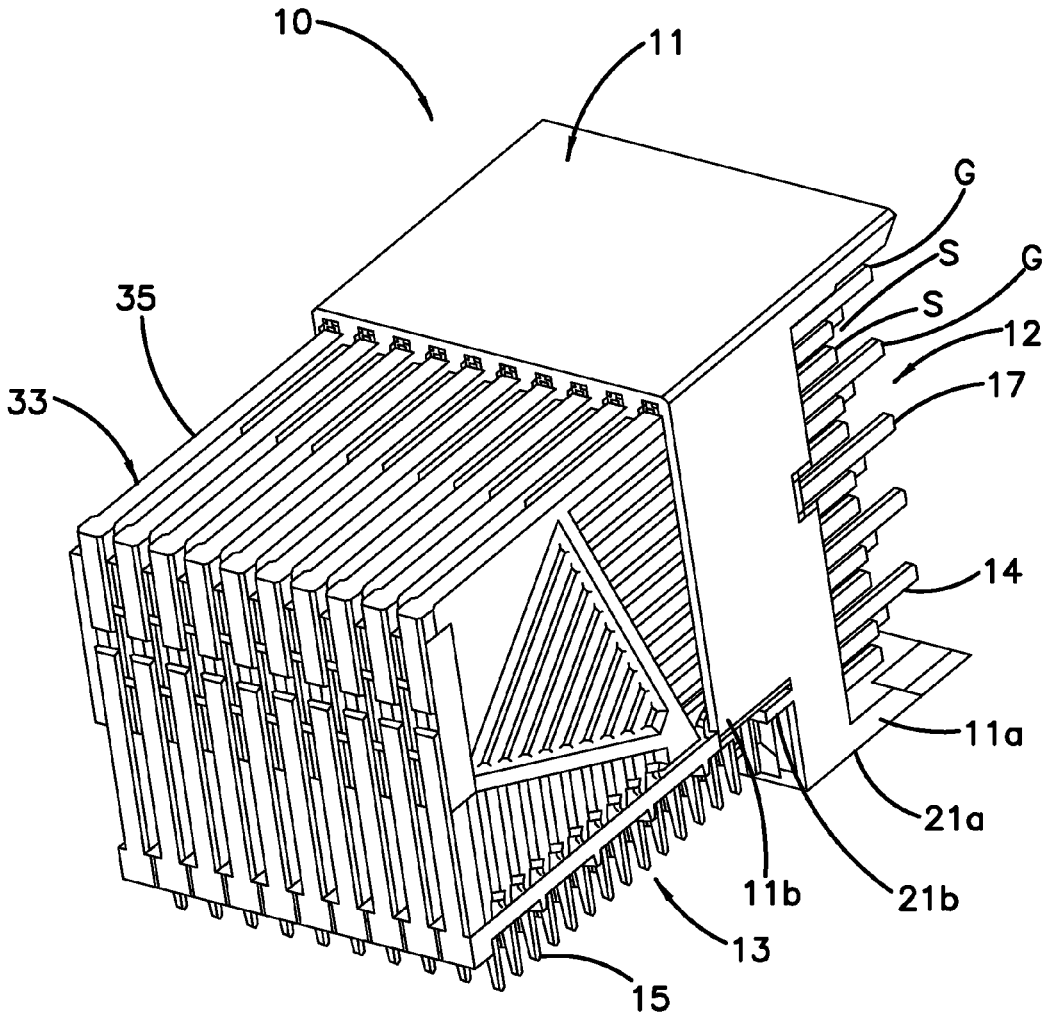
Fig.1A (PRIOR ART)
FIG. 1A is a perspective view of a conventional electrical connector.
Figure 1B:
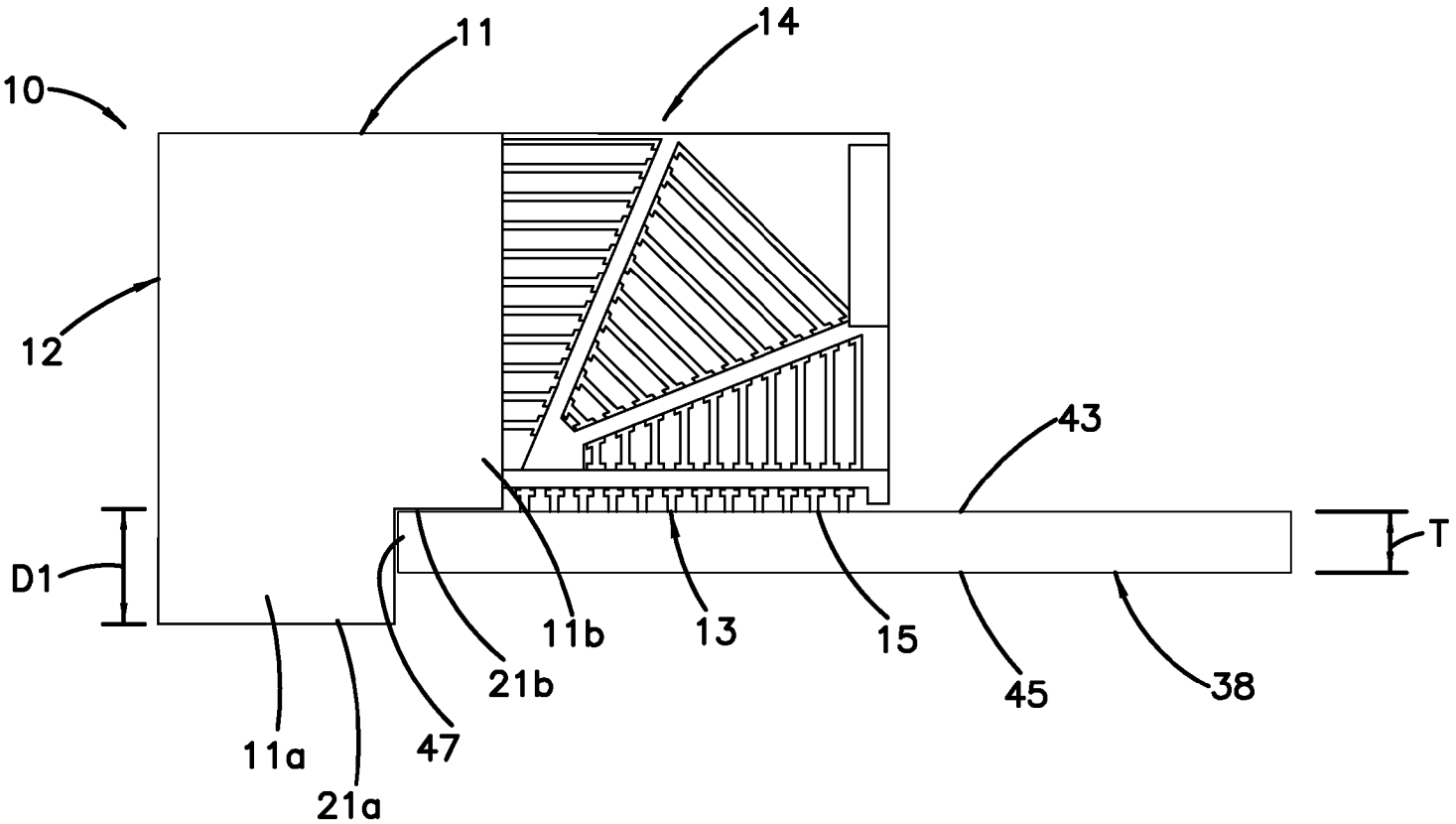
Fig.1B (PRIOR ART)
FIG. 1B is a side elevation view of the conventional electrical connector illustrated in FIG. 1A, shown mounted to a printed circuit board.

In accordance with the illustrated embodiment, the gaps 66 and 68 can be created by constructing an electrical connector similar to the conventional electrical connector 10 illustrated in FIG. 1, but having a select ones of the electrical contacts of the electrical connector removed so as to allow for a height reduction of the connector housing 27 at the mating interface with respect to the connector housing 11. For instance, the select ones of the electrical contacts 14 can define the bottom-most mating portions 15 of the electrical connector 10 such that the electrical connector 10 does not include any other electrical contacts 14 whose mating portions 15 are disposed below the mating portions 14 of the select one of electrical contacts 14. Furthermore, the mating portions 15 of at least some of the select ones of electrical contacts 14 can be disposed below the lower surface 45 of the printed circuit board 38.

Because the first electrical connector 22 is devoid of the select ones of the electrical contacts 14 of the conventional electrical connector 10, the bottom surface 36 of the connector housing 27 can be raised at the longitudinally front portion 27*a* with respect to the bottom surface of the connector housing 11 of the conventional electrical connector 10. Accordingly, the connector housing 27 extends down from the upper surface 60 of the first substrate 24 to a depth D2 that is less than the transverse substrate thickness T of the first substrate 24, as described above. For instance, the mating portions of the three bottom-most electrical contacts 14 of the electrical connector 10 (or closest to the substrate 38 when the connector 10 is mounted to the substrate 38) are disposed below the upper mounting surface 43, and extend to a location below the lower surface 45 of the substrate 38. Thus, the electrical contacts corresponding to the bottom-most three mating portions of the electrical contacts of the conventional electrical connector 10 have been removed so as to define an arrangement of the electrical contacts 46 of the first electrical connector 22. The removed contacts include the bottom-most pair of signal contacts S and an adjacent ground contact G.

Thus, in accordance with one embodiment, a method can be provided for reducing a height of an electrical connector. The method can include the step of providing or teaching the use of a printed circuit board, such as the printed circuit board 38 having upper and lower surfaces 43 and 45, the printed circuit board further including an edge 47 that defines at least a portion of an outer perimeter of the printed circuit board 38. The method can further include the step of identifying a first electrical connector, such as the conventional electrical connector 10, having a connector housing 11 and a plurality of electrical contacts 14 retained by the connector housing 11, each of the plurality of electrical contacts 14 defining a mating portion 17 configured to mate with a complementary electrical connector, and each of the plurality of electrical contacts defining an opposed mounting portion 15 configured to be mounted to the printed circuit board 38. The method can further include the step of identifying select mating portions of a select number of electrical contacts among the plurality of electrical contacts 14 that extend below the lower surface 45 of the printed circuit board 38 when the electrical connector 10 is mounted to the upper surface 43 of the printed circuit board 38. The method can further include the step of teaching the step of constructing a modified electrical connector, such as the first electrical connector 22, that is constructed substantially identically with respect to the first electrical connector 10, wherein the modified electrical connector is devoid of the select number of electrical contacts such that the connector housing of the second electrical connector terminates at a location between the upper and lower surfaces of the printed circuit board to which the modified electrical connector is functionally related (e.g., can be placed in electrical communication with the printed circuit board).

It should be further appreciated that a kit can include at least one electrical connector, which in one embodiment can be constructed as described above with respect to the conventional electrical connector 10, which can define a front portion 11*a* and a rear portion 11*b* that is spaced from the front portion 11*a*, such that the mounting portions 15 of the electrical contacts 14 extend down from the rear portion 11*b*. The front and rear portions 11*a* and 11*b* each define respective bottom ends 21*a-b*, whereby the bottom end 21*a* of the front portion 11*a* is spaced from the bottom end 21*b* of the rear portion 11*b* a distance greater than the thickness T of the substrate 38. Thus, the bottom end 21*a* of the front portion 11*a* is spaced from the bottom end 21*b* of the rear portion 11*b* a distance greater than 0.92 inch. Furthermore, the electrical contacts 14 can be supported by a plurality of leadframe assemblies 33 that include dielectric leadframe housings 35 that support the electrical contacts 14 in respective columns that are spaced apart along a row direction that extends substantially perpendicular to the column. The mounting portions 15 of the electrical contacts 14 of each leadframe assembly 33 are spaced apart along a column pitch. The conventional electrical connector 10 defines a select number of electrical contacts that define forward-most mounting portions, such that no mounting portions are disposed between the forward-most mounting portion and the front portion 11*a* of the connector housing 11. The forward-most mounting portion is spaced from the front portion 11*a* of the connector housing 11*a* distance less than three times the column pitch, for instance less than twice the column pitch. Thus, the forward-most mounting portions of the conventional electrical connector 10 are spaced from the respective front portion 11*a* of the respective connector housing 11*a* distance less than a distance that the forward-most mounting portions 54*a* that are spaced from the longitudinally front portion 27*a* of the connector housing 27. The kit can further include a second electrical connector, which can be constructed as described above with respect to the first electrical connectors 22. The kit can further include a third electrical connector, which can be constructed as described above with respect to the second electrical connectors 26. The electrical connectors of the kit can be sold contemporaneously with each other as a single package, or can be sold in separate packages at temporally displaced times.

Thus, the first electrical connector 22 and corresponding connector housing 27 can be respectively constructed substantially identically with respect to a second electrical connector, which can be the conventional electrical connector 10 and the respective connector housing 11, and can thus overhang, or extend forward from, the edge 59 of the first substrate 24. In particular, the front portion 22*a* of the connector housing 22 can overhang the edge 59 of the first substrate 24. However, the front portion bottom surface 29*a* of the connector housing 27 does not extend below the lower surface 62 of the first substrate 24 when the first electrical connector 22 is mounted to the upper surface 60 of the first substrate 24. Otherwise stated, the connector housing 27, for instance at the front portion 27*a*, does not cross a plane defined by the lower surface 62 of the first substrate 14. The rear portion bottom surface 29*b* of the bottom end 26 of the connector housing 22 is disposed above the mounting surface 43 of the substrate 38. Thus, it should be appreciated that the first electrical connector 22 can be constructed substantially identically with respect to the conventional electrical connector 10, except that the select number of electrical contacts 14, for instance that define the three bottom-most mating portions 15, have been removed. As a result, each leadframe housing 50 can have a height less than the leadframe housings of the conventional electrical connector 10, as defined as the transverse distance between the top end 34 and the bottom end 36, and the connector housing 27 can also have a height less than that of the connector housing 11 of the conventional electrical connector 10. In accordance with one embodiment, the connector housing 27 can extend to a height above the upper surface 60 of the first substrate 24 a distance that is substantially equal to the distance that the connector housing 11 extends above the upper surface 43 of the printed circuit board 38.

It should be further appreciated that a method of selling electrical connectors can include the steps of offering for sale at least a first electrical connector, which can be constructed as described above with respect to the conventional electrical connector 10, and offering for sale at least a second electrical connector, which can be constructed as described above with respect to the first electrical connector 22. It should be further appreciated that a method of manufacturing electrical connectors can include the steps of manufacturing at least a first electrical connector, which can be constructed as described above with respect to the conventional electrical connector 10, and manufacturing at least a second electrical connector, which can be constructed as described above with respect to the first electrical connector 22.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. A right-angle electrical connector comprising:

a connector housing and a plurality of electrical contacts supported by the connector housing, wherein the connector housing includes a rear portion and a front portion spaced forward from the rear portion, each of the front and rear portions defining a respective bottom end, such that the bottom end of the rear portion is configured to rest on a substrate when the right-angle electrical connector is mounted to the substrate, and the bottom end of the front portion extends forward from the substrate, wherein the electrical contacts define mating portions configured to mate with a second electrical connector and further define mounting portions that extend down with respect to the bottom end of the rear portion, the electrical contacts are disposed in a plurality of columns, and the right-angle electrical connector further comprises a select number of electrical contacts among the plurality of electrical contacts that each define a forward-most mounting portion such that no other contact in the respective column defines a mounting portion that is disposed between the forward-most mounting portion and the front portion of the connector housing, wherein the mounting portions of the electrical contacts of each column are spaced apart by a column pitch, and the forward-most mounting portions are spaced from the front portion a distance greater than three times the column pitch and less than nine times the column pitch.

2. The right-angle electrical connector as recited in claim 1, wherein the bottom end of the rear portion rests on an upper surface of the substrate when the right-angle electrical connector is mounted to the substrate, and the front portion overhangs the upper surface of the substrate and extend down toward a lower surface of the substrate that is opposite the upper surface, such that the front portion terminates without the bottom end of the front portion crossing a plane that extends along the lower surface of the substrate when the electrical connector is mounted onto the substrate.

3. The right-angle electrical connector as recited in claim 2, wherein the bottom end of the front portion is disposed between a first plane that extends along the upper surface and a second plane that extends along the lower surface when the right-angle electrical connector is mounted to the substrate.

4. The right-angle electrical connector as recited in claim 3, wherein the bottom end of the front portion is disposed below the bottom end of the rear portion a distance less than 0.92 inches.

5. The right-angle electrical connector as recited in claim 2, further comprising a plurality of leadframe assemblies, each leadframe assembly including a leadframe housing and respective ones of the plurality of electrical contacts supported by the leadframe housing.

6. The right-angle electrical connector as recited in claim 5, wherein each of the leadframe housings is overmolded onto the respective ones of the plurality of electrical contacts.

7. The right-angle electrical connector as recited in claim 1, further comprising a plurality of leadframe assemblies, each leadframe assembly including a leadframe housing and respective ones of the plurality of electrical contacts supported by the leadframe housing.

8. The right-angle electrical connector as recited in claim 7, wherein each of the leadframe housings is overmolded onto the respective ones of the plurality of electrical contacts.

9. The right-angle electrical connector as recited in claim 1, wherein the bottom end of the front portion is disposed below the bottom end of the rear portion a distance less than 0.92 inches.

10. A kit comprising:

1) at least a first right-angle electrical connector configured to be mounted onto an upper mounting surface of a corresponding printed circuit board, the printed circuit board further defining a lower surface spaced from the upper mounting surface so as to define a thickness, the first right-angle electrical connector comprising:

a connector housing and a plurality of electrical contacts supported by the connector housing, wherein the connector housing includes a rear portion and a front portion spaced forward from the rear portion, each of the front and rear portions defining a respective bottom end, wherein the electrical contacts define mating portions configured to mate with a corresponding complementary electrical connector and further define mounting portions that extend down with respect to the bottom end of the rear portion, and the bottom end of the front portion is downwardly spaced from the bottom end of the rear portion a distance greater than the thickness of the printed circuit board; and 2) at least a second right-angle electrical connector configured to be mounted onto an upper mounting surface of a corresponding printed circuit board, the printed circuit board further defining a lower surface spaced from the upper mounting surface so as to define a thickness, the second right-angle electrical connector comprising:

a connector housing and a plurality of electrical contacts supported by the connector housing, wherein the connector housing of the second right-angle connector includes a rear portion and a front portion spaced forward from the rear portion, each of the front and rear portions of the second right-angle electrical connector defining a respective bottom end, wherein the electrical contacts of the second right-angle electrical connector define mating portions configured to mate with a corresponding complementary electrical connector and further define mounting portions that extend down with respect to the bottom end of the rear portion of the second right-angle electrical connector, and the bottom end of the front portion of the second right-angle electrical connector is downwardly spaced from the bottom end of the rear portion a distance less than the thickness of the printed circuit board corresponding to the second right-angle electrical connector.

11. The kit as recited in claim 10, wherein the electrical contacts of each of the first and second right-angle connectors define a select number of electrical contacts whose mounting portions are forward-most mounting portions such that no mounting portions are disposed between the forward-most mounting portions and the front portion of the connector housing, and the forward-most mounting portions of the first right-angle connector are spaced from the front portion of the respective front portion of the connector housing a distance less than a distance that the forward-most mounting portions of the second right-angle connector are spaced from the respective front portion of the connector housing.

12. A method of selling electrical connectors, the method comprising the steps of:

1) offering for sale a first right-angle electrical connector that is configured to be mounted onto an upper mounting surface of a corresponding printed circuit board, the printed circuit board further defining a lower surface spaced from the upper mounting surface so as to define a thickness, the first right-angle electrical connector comprising:

a connector housing and a plurality of electrical contacts supported by the connector housing, wherein the connector housing includes a rear portion and a front portion spaced forward from the rear portion, each of the front and rear portions defining a respective bottom end, wherein the electrical contacts define mating portions configured to mate with a corresponding complementary electrical connector and further define mounting portions that extend down with respect to the bottom end of the rear portion, and the bottom end of the front portion is downwardly spaced from the bottom end of the rear portion a distance greater than the thickness of the printed circuit board; and 2) offering for sale a second right-angle electrical connector configured to be mounted onto an upper mounting surface of a corresponding printed circuit board, the printed circuit board further defining a lower surface spaced from the upper mounting surface so as to define a thickness, the second right-angle electrical connector comprising:

a connector housing and a plurality of electrical contacts supported by the connector housing, wherein the connector housing of the second right-angle connector includes a rear portion and a front portion spaced forward from the rear portion, each of the front and rear portions of the second right-angle electrical connector defining a respective bottom end, wherein the electrical contacts of the second right-angle electrical connector define mating portions configured to mate with a corresponding complementary electrical connector and further define mounting portions that extend down with respect to the bottom end of the rear portion of the second right-angle electrical connector, and the bottom end of the front portion of the second right-angle electrical connector is downwardly spaced from the bottom end of the rear portion a distance less than the thickness of the printed circuit board corresponding to the second right-angle electrical connector.

13. A method of reducing a height of an electrical connector, the method comprising the steps of:

providing or teaching the use of a printed circuit board having upper and lower surfaces, and an outer surface that extends between the upper and lower surfaces, the printed circuit board further including an edge that defines at least a portion of an outer perimeter of the printed circuit board;

identifying a first electrical connector having a connector housing and a plurality of electrical contacts retained by the connector housing, each of the plurality of electrical contacts defining mating portions configured to mate with a complementary electrical connector, and each of the plurality of electrical contacts defining an opposed mounting portion configured to be mounted to the printed circuit board, identifying select mating portions of a select number of electrical contacts among the plurality of electrical contacts, wherein the select mating portions are disposed below the lower surface of the printed circuit board when the electrical connector is mounted to the upper surface of the printed circuit board; and teaching the step of constructing a modified electrical connector that is constructed substantially identically with respect to the first electrical connector, wherein the modified electrical connector is devoid of the select number of electrical contacts such that the connector housing of the modified electrical connector terminates at a location between the upper and lower surfaces of the printed circuit board.

14. The method as recited in claim 13, wherein the connector housing of the modified electrical connector includes a rear housing portion configured to rest on the upper surface of the printed circuit board, and a front housing portion configured to overhang the printed circuit board when the modified electrical connector is mounted to the printed circuit board, and the modified electrical connector defines a forward-most mounting portion such that no electrical contact of the modified electrical connector is disposed between the forward-most mounting portion and the front portion, wherein the mounting portions of the electrical contacts of the modified electrical connector are spaced apart by a column pitch, and the forward-most mounting portion is spaced from the front portion a distance greater than three times the column pitch and less than nine times the column pitch.

* * * * *